US006439915B2

(12) United States Patent
Kurimoto

(10) Patent No.: US 6,439,915 B2
(45) Date of Patent: Aug. 27, 2002

(54) CONNECTOR

(75) Inventor: Naoya Kurimoto, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/742,440

(22) Filed: Dec. 22, 2000

(30) Foreign Application Priority Data

Dec. 27, 1999 (JP) ..... 11-369583

(51) Int. Cl.[7] ..... H01R 13/627
(52) U.S. Cl. ..... 439/352; 439/489; 439/354
(58) Field of Search ..... 439/488, 489, 439/350, 352, 354

(56) References Cited

U.S. PATENT DOCUMENTS

| | | | | |
|---|---|---|---|---|
| 4,950,179 A | | 8/1990 | Takenouchi et al. | |
| 5,330,369 A | * | 7/1994 | Nozaki et al. | 439/489 |
| 5,507,666 A | * | 4/1996 | Yamanashi | 439/489 |
| 5,605,472 A | * | 2/1997 | Sakai et al. | 439/489 |
| 5,618,201 A | * | 4/1997 | Yagi et al. | 439/489 |
| 5,672,073 A | | 9/1997 | Matsumura et al. | |
| 5,681,178 A | * | 10/1997 | Kunkle et al. | 439/489 |
| 5,910,027 A | * | 6/1999 | Wayt et al. | 439/489 |
| 5,910,028 A | * | 6/1999 | Tsuji | 439/489 |
| 5,938,470 A | * | 8/1999 | Kashiyama | 439/489 |
| 6,109,955 A | * | 8/2000 | Hanazaki et al. | 439/489 |

FOREIGN PATENT DOCUMENTS

| | | |
|---|---|---|
| EP | 891 014 | 1/1999 |
| GB | 2246030 | 1/1992 |
| JP | 4-33666 | 8/1992 |

* cited by examiner

*Primary Examiner*—Gary P. Paumen
*Assistant Examiner*—Felix O. Figueroa
(74) *Attorney, Agent, or Firm*—Banner & Witcoff, Ltd.

(57) ABSTRACT

The invention provides a compact configuration for an electrical connector having a fitting detecting function.

A housing groove 25 of a female housing 20 is provided with a locking arm 26 and a detecting member 35. The locking arm 26 bends while two housings 10 and 20 are being fitted together, then returns to its original position after the two housings 10 and 20 have reached a correct fitting state and engages with a protrusion 16 of the male housing 10. The detecting member 35 is capable of being inserted from a temporary attaching position to a main attaching position. When the locking arm 26, while in a bent state, makes contact with the detecting member 35 and thereby prevents its insertion, this allows detection of the fact that the two housings 10 and 20 have not been correctly fitted together. A retaining rod 42 is provided in the center of an anterior face of the detecting member 35, and a pair of contacting rods are provided on both sides of the retaining rod 42. These contacting rods make contact with stoppers 45, and a retaining hook 47 at the anterior end of the retaining rod 42 engages with a locking member 30 of the locking arm 26. This retains the detecting member 35 in the posterior direction and maintains it in the temporary attaching position.

11 Claims, 8 Drawing Sheets

CONNECTOR

TECHNICAL FIELD

The present invention relates to an electrical connector provided with a fitting detecting function.

BACKGROUND TO THE INVENTION

One conventional example of this type of connector is described in JP 4-33666. In this example, one of a pair of housings capable of fitting mutually together is provided with a locking arm which bends resiliently as the two housings are being fitted together, returns to its original position when the two housings are correctly fitted together, and retains the other housing. This housing is also provided with a detecting member capable of being inserted from the exterior into the interior of the space along which the locking arm moves. The locking arm makes contact with the detecting member as this locking arm moves resiliently, thereby regulating the insertion of the detecting member. By this means, it can be detected whether the two housings have been correctly fitted together.

This detecting member is comparatively small. Consequently, it may be dropped and lost as it is inserted into or removed from the housing. As a result, the detecting member is kept attached in a temporary position to the exterior of the space along which the locking arm moves.

However, in the conventional example, components which retain the detecting member in an unremovable state when it is in the temporary position consist of a stepped member which protrudes from a side face of the detecting member, and a protrusion which engages with the stepped member and which is provided on a side wall that guides the sliding of the detecting member. These components are bulky, particularly in the width-wise direction of the housing (the direction at a right-angle to the direction of insertion of the detecting member), and could be improved.

The present invention has taken the above problem into consideration, and aims to provide this improvement.

SUMMARY OF THE INVENTION

According to the invention there is provided an electrical connector comprising two mutually engageable connector housings, one of said housings having a resilient latching arm for engaging and retaining the other of said housings in a fully fitted condition, said latching arm having a bending space to permit bending thereof during movement of said housings through a half fitted condition to the fully fitted condition, and wherein a detecting member is insertable from the exterior into said bending space, insertion of said detecting member being prevented by bending of said latching arm in the half fitted condition.

Preferably the latching arm is a cantilever having a free end engageable by a frame-like aperture of said detecting member, the detecting member being slidable on said one housing in the direction of attachment with said other housing.

In a preferred embodiment the detecting member has a resilient elongate member extending in said attachment direction and engageable by an abutment of said one connector housing to prevent further movement into said bending space, a releasing member of the other connector housing bending said elongate member out of engagement with said abutment to permit movement into said bending space when said latching member is not bent.

The detecting member preferably has two parallel, resilient elongate members in mirror image and having mutually facing recesses for engagement by respective abutments of said other housing.

BRIEF DESCRIPTION OF THE DRAWINGS

Other aspects of the invention will be apparent from the following description of a preferred embodiment shown by way of example only in the accompanying drawings in which.

DESCRIPTION OF PREFERRED EMBODIMENT

An embodiment of the present invention is described below with the aid of FIGS. 1 to 19.

Figure 1:
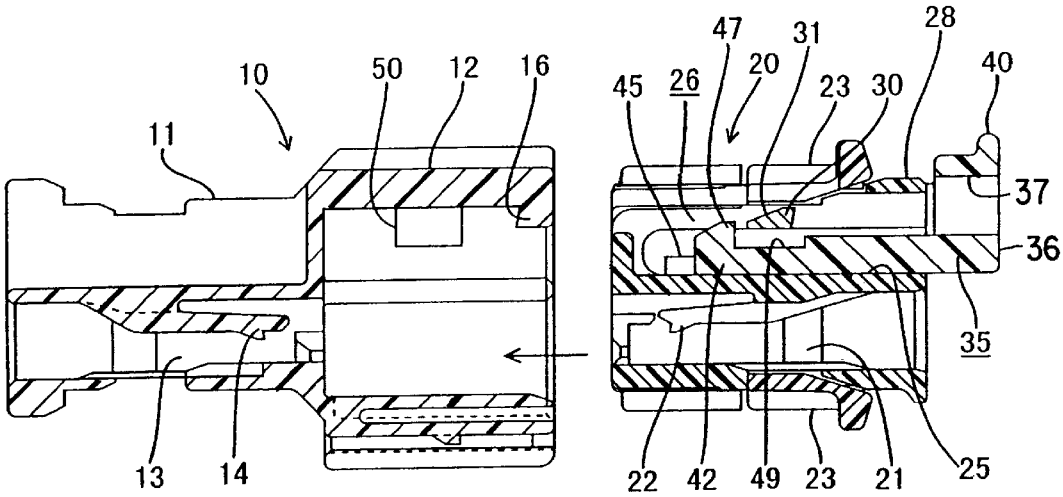
FIG. 1 is a vertical cross-sectional view of an embodiment of the present invention showing male and female housings prior to being fitted together.

As shown in FIG. 1, the present embodiment is provided with a male connector housing 10, and a female connector housing 20, these two housings 10 and 20 being capable of being fitted together. As will be explained in detail later, the female housing 20 is provided with a locking arm 26, for locking the two housings 10 and 20 in a locked state, and a detecting member 35 for detecting whether the two housings 10 and 20 have been correctly fitted together.

The fitting face sides of the two housings 10 and 20 are considered to be the anterior sides.

Figure 2:
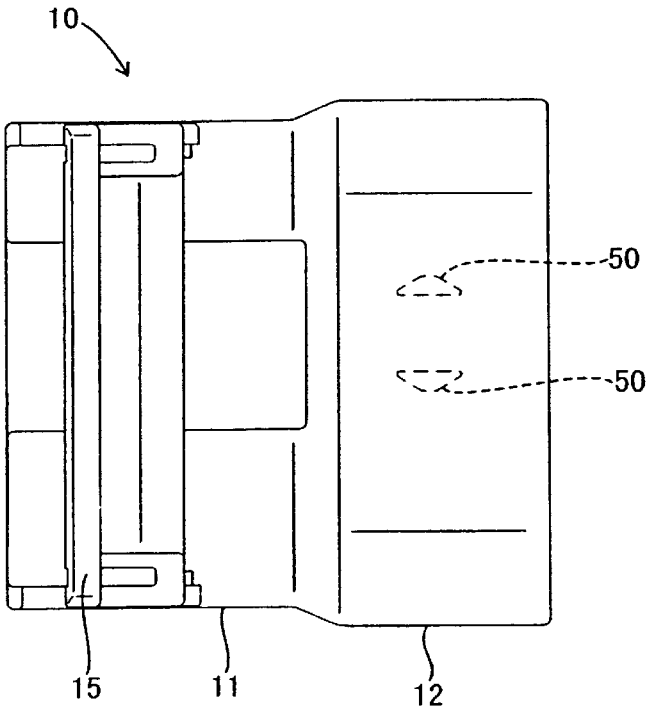
FIG. 2 is a plan view of the male housing.
Figure 3:
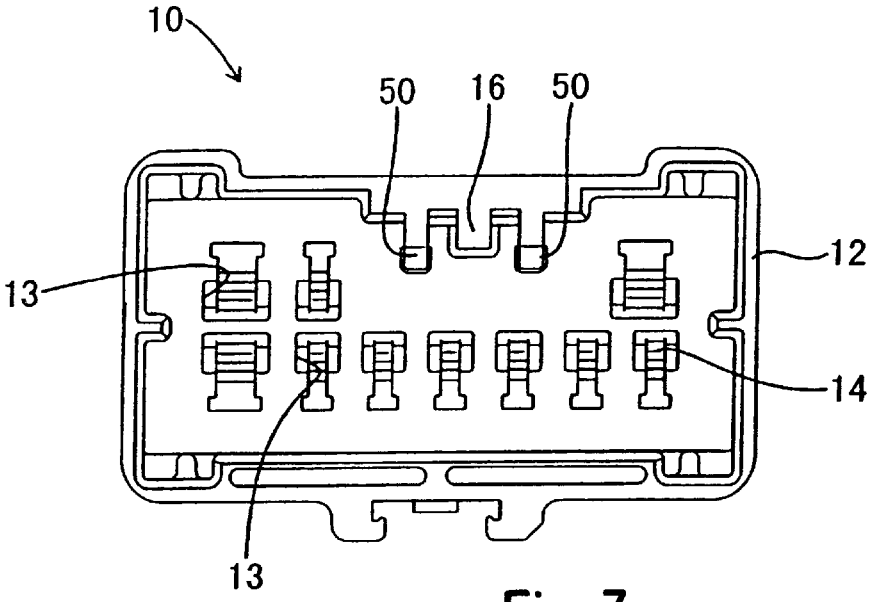
FIG. 3 is a front view of the male housing.

As shown in FIGS. 2 and 3, the male housing 10 has a terminal housing chamber 11 which has a flat block shape. An approximately angular tubular hood 12 is provided on an anterior side of the terminal housing chamber 11. Cavities 13 are formed along the entire width of the terminal housing chamber 11 in a lower layer and are formed in the vicinity of a central portion thereof in an upper layer. Male terminal fittings (not shown) are inserted from the posterior into each cavity 13 and engage with lances 14 provided on ceiling faces of the cavities 13, and tabs of the male terminal fittings protrude into the hood 12 and are housed therein an unremovable state. The male terminal fittings are then doubly retained by a side retainer 15.

Figure 4:
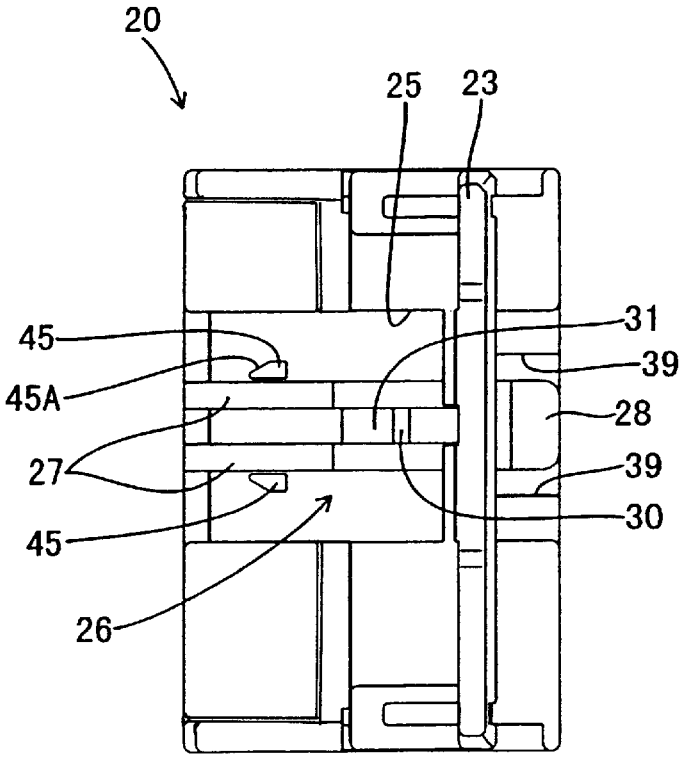
FIG. 4 is a plan view of the female housing.
Figure 6:
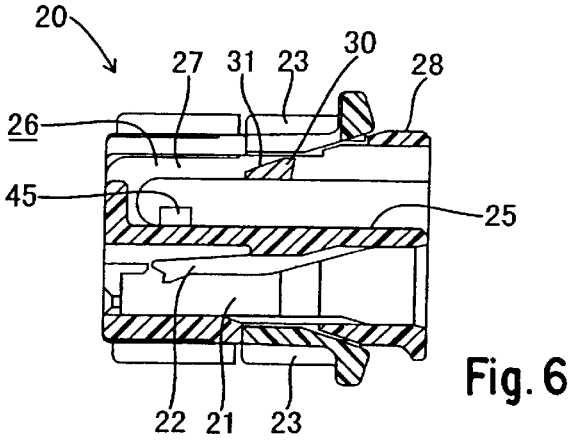
FIG. 6 is a vertical cross-sectional view of the female housing.

As shown in FIGS. 4 and 6, the female housing 20 has a flat block shape, an anterior side thereof fitting into the hood 12 of the male housing 10. Cavities 21 are formed within the female housing 20 so as to correspond to the cavities 13 of the male housing 10, these being formed along the entire width of the female housing 20 in a lower layer and in the vicinity of a central portion thereof in an upper layer. Female terminal fittings (not shown) are inserted from the posterior into each cavity 21 and engage with lances 22 provided on ceiling faces of the cavities 21. The female terminal fittings are thereby housed in an unremovable state and are subsequently doubly retained by a side retainer 23.

The portion of the female housing 20 which is not provided with the upper layer of cavities 13 has a housing groove 25 formed therein. This housing groove 25 faces an anterior-posterior direction, the locking arm 26 being formed therein in a central portion thereof relative to its width-wise direction. The locking arm 26 has two arm members 27 which are formed in a parallel manner with a space therebetween. These arm members 27 rise upwards from an anterior end (the left side in FIG. 6) of the housing groove 25 and extend towards the posterior. Upper faces of extending ends of the arm members 27 are joined by a pressing member 28, these extending ends being capable of moving downwards. A locking member 30 is formed between the arm members 27 at an approximately central location relative to the length-wise direction thereof. An upper face of an anterior edge of this locking member 30 forms a tapered guiding face 31.

As shown in FIGS. 1 and 3, a protrusion 16 is formed on the hood 12 of the male housing 10 at a location corresponding to the locking arm 26. An anterior edge of this protrusion 16 faces downwards.

As a result, the protrusion 16 makes contact with the guiding face 31 of the locking member 30 of the locking arm 26 while the female housing 20 is being fitted into the hood 12 of the male housing 10. Consequently, the locking arm 26 is bent downwards as it is being pushed inwards. When the female housing 20 is pushed in to the correct fitting position so that it reaches an inner wall of the hood 12, the locking member 30 passed the protrusion 16, the locking arm 26 then returns to its original position, and the locking member 30 engages with the protrusion 16, thereby locking the two housings 10 and 20 in the correctly fitted state (see FIG. 15).

Figure 7:
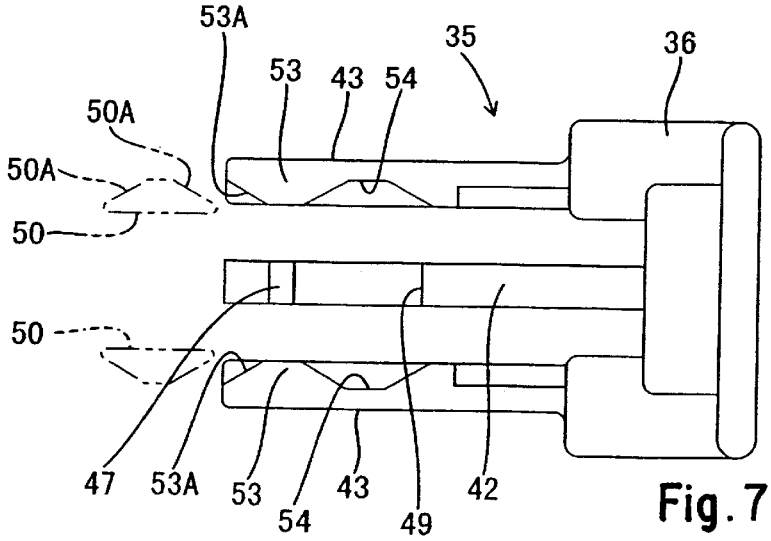
FIG. 7 is a plan view of a detecting member.
Figure 8:
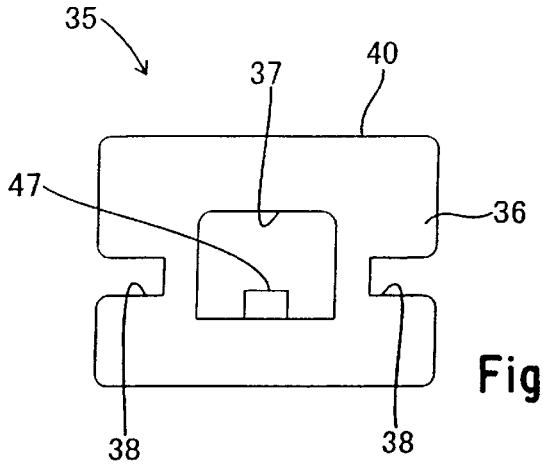
FIG. 8 is a rear face view of the detecting member.
Figure 9:
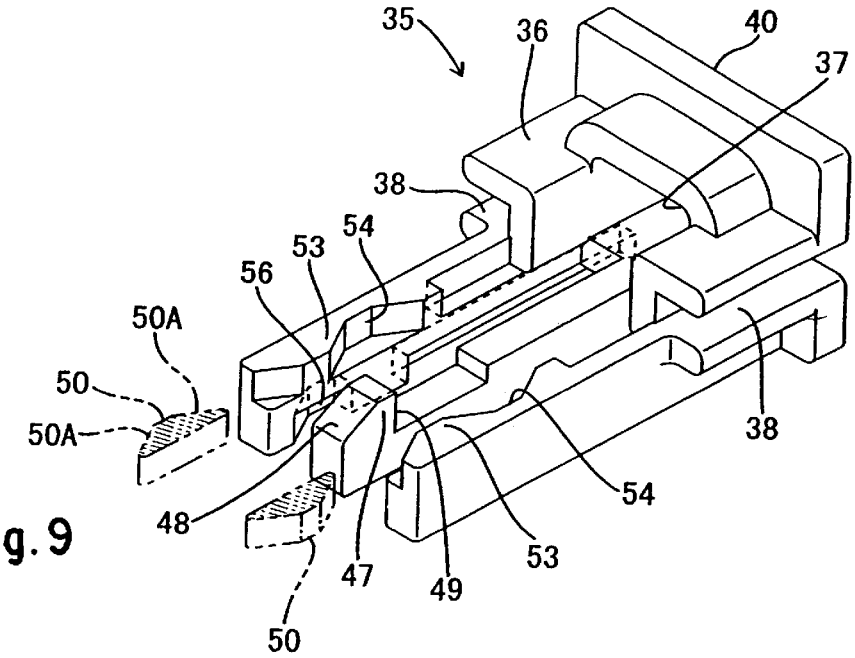
FIG. 9 is a diagonal view of the detecting member.

The detecting member 35 for detecting whether the two housings 10 and 20 are in the correctly fitted state is attached to the housing groove 25 of the female housing 20. The detecting member 35 is made from plastic and is formed as shown in FIGS. 7 to 9. The detecting member 35 has a base member 36 which fits tightly with the housing groove 25 along its width-wise direction. This base member 36 also serves to facilitate the insertion of the detecting member 35. The base member 36 has a square frame shape, a central portion thereof forming a fitting hole 37 into which the extending ends of the locking arm 26 can be fitted.

Figure 5:
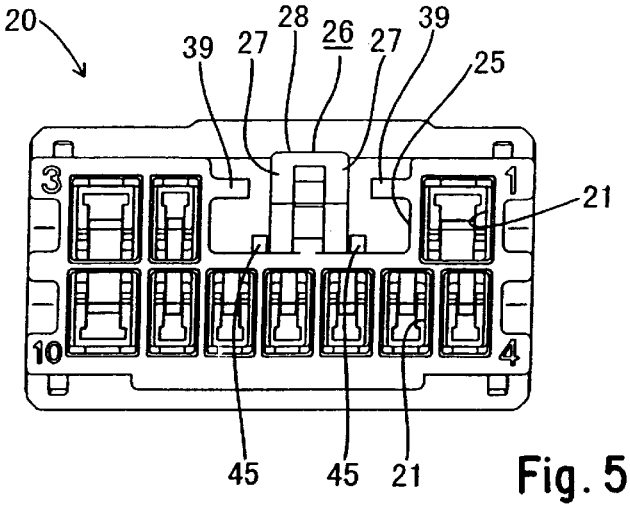
FIG. 5 is a rear face view of the female housing.

Guiding grooves 38 are formed in an anterior-posterior direction in left and right faces of the base member 36 and, as shown in FIG. 5, guiding plates 39 protrude from opening sides of left and right side walls of the housing groove 25 of the female housing 20. These guiding plates 39 fit with the guiding grooves 38 in a manner whereby they slide freely therein. Furthermore, a catching member 40, which is used to return the detecting member 35 to the posterior, protrudes upwards from an upper face of a posterior end of the base member 36.

Figure 13:
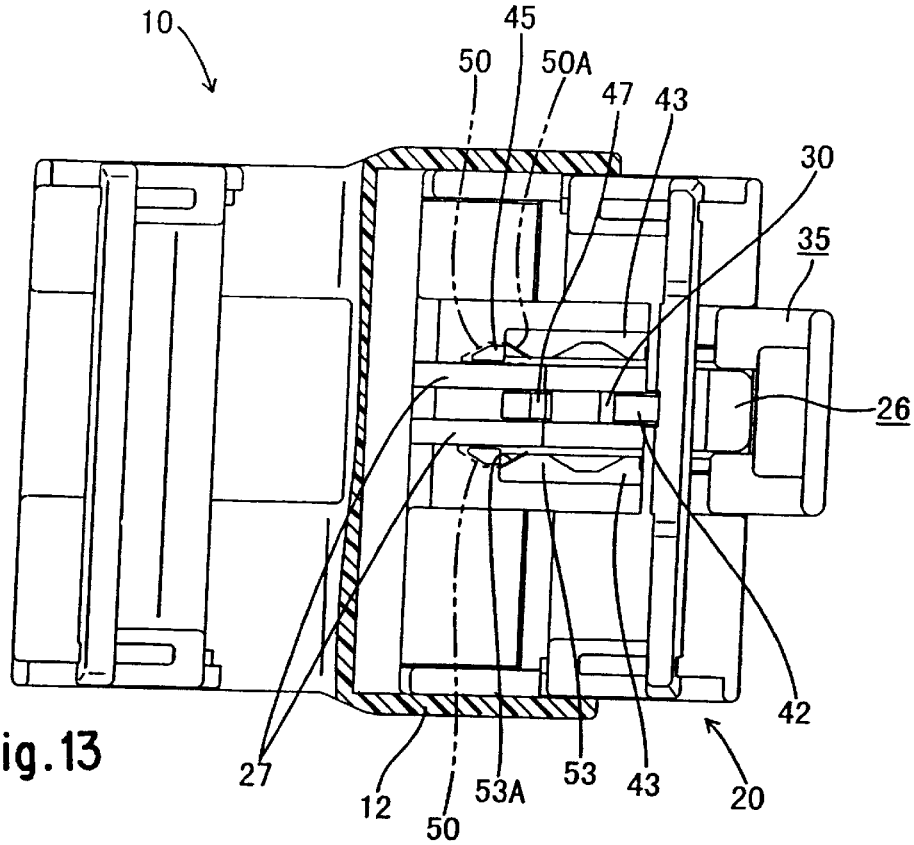
FIG. 13 is a partially cut-away plan view of the above.

A lower portion of the anterior face of the base member 36 is provided with a retaining rod 42 which protrudes therefrom at a central location relative to the width-wise direction thereof, and a pair of contacting rods 43 which protrude along both sides of the retaining rod 42 and are separated from it by a specified distance. The retaining rod 42 and the contacting rods 43 have a square bar shape when seen from a vertical length-wise cross-sectional view, and the tips thereof protrude to the same extent. When the detecting member 35 is in a state whereby the base member 36 is fully fitted with the housing groove 25 and the lower faces of the detecting member 35 make contact with a groove base from the base member 36 to the contacting rods 43, the detecting member 35 can move smoothly within the housing groove 25 along the guiding plates 39. As shown in FIG. 13, after the detecting member 35 has been attached within the housing groove 25, the arm members 27 of the locking arm 26 come to be located in the spaces between the retaining rod 42 and the contacting rods 43 at both sides of this retaining rod 42. Spaces are formed between the contacting rods 43 and side faces of the housing groove 25, these contacting rods 43 being capable of bending towards the side faces of the housing groove 25.

Figure 10:
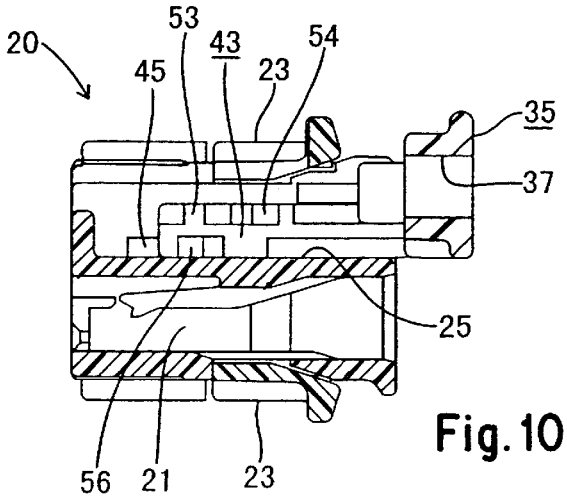
FIG. 10 is a vertical cross-sectional view showing the female housing with the detecting member attached in a temporary position.
Figure 11:
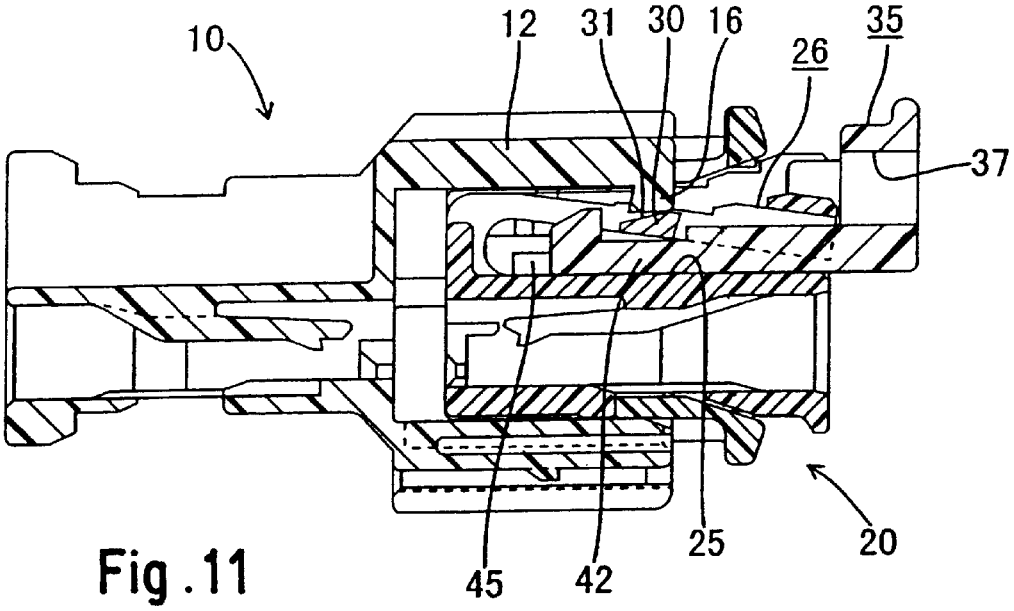
FIG. 11 is a vertical cross-sectional view, shown from the position of a locking arm, of the male and female housings being fitted together.

A pair of left and right stoppers 45 are formed on the base of the housing groove 25 at locations towards an anterior end thereof. As shown in FIGS. 10 and 11, these stoppers 45 make contact with lower inner ends of anterior end faces of the contacting rods 43 of the detecting member 35. A retaining hook 47, which is capable of engaging with the locking member 30 of the locking arm 26, protrudes from an upper face of an anterior end face of the retaining rod 42. An upper portion of an anterior face of this retaining hook 47 forms an inclined guiding face 48. A recessed member 49 for the locking member 30 is formed directly to the posterior of the retaining hook 47.

The detecting member 35 is attached in the temporary position within the housing groove 25 before the retainer 23 is attached in a main retaining position. While the detecting member 35 is being inserted from the posterior into the housing groove 25, the guiding face 48 of the retaining hook 47 of the retaining rod 42 makes contact with the locking member 30 of the locking arm 26, the locking arm 26 is bent slightly upwards, and the detecting member 35 is pushed inwards. Then the two contacting rods 43 make contact with the corresponding stoppers 45, thereby halting the insertion process. At this juncture, the retaining hook 47 passes the locking member 30, thereby allowing the locking arm 26 to return to its original position, and the retaining hook 47 enters a space to the anterior of the locking member 30, thereby retaining detecting members 35 in the posterior direction.

This constitutes the temporary attaching position of the detecting member 35. In this temporary attaching position, as shown in FIG. 1, the locking arm 26 is in a state whereby the extending ends thereof can bend downwards. That is, the extending ends of this locking arm 26 are located to the anterior of the base member 36 of the detecting member 35, and the locking member 30 is located above the recessed member 49.

A pair of releasing members 50, for releasing the engaged state of the detecting member 35 is in the anterior direction, are formed on a ceiling face of the hood 12 of the male housing 10. As shown in FIG. 7, these releasing members 50 protrude downwards from a central location relative to the length-wise direction of the ceiling face, and make sliding contact with upper, inner ends of the anterior end faces of the contacting rods 43. The releasing members 50 have a cross-sectionally angled shape, having inclined faces 50A on both sides, the apexes thereof facing opposing sides. Contacting members 53 and upper stopping holes 54 are formed on inner faces of upper portions of the two retaining rods 43. The contacting members 53, which have a cross-sectionally angled shape corresponding to the shape of the releasing members 50, are formed closer to the anterior ends of the contacting rods 43 than the concave-shaped upper stopping holes 54.

Figure 14:
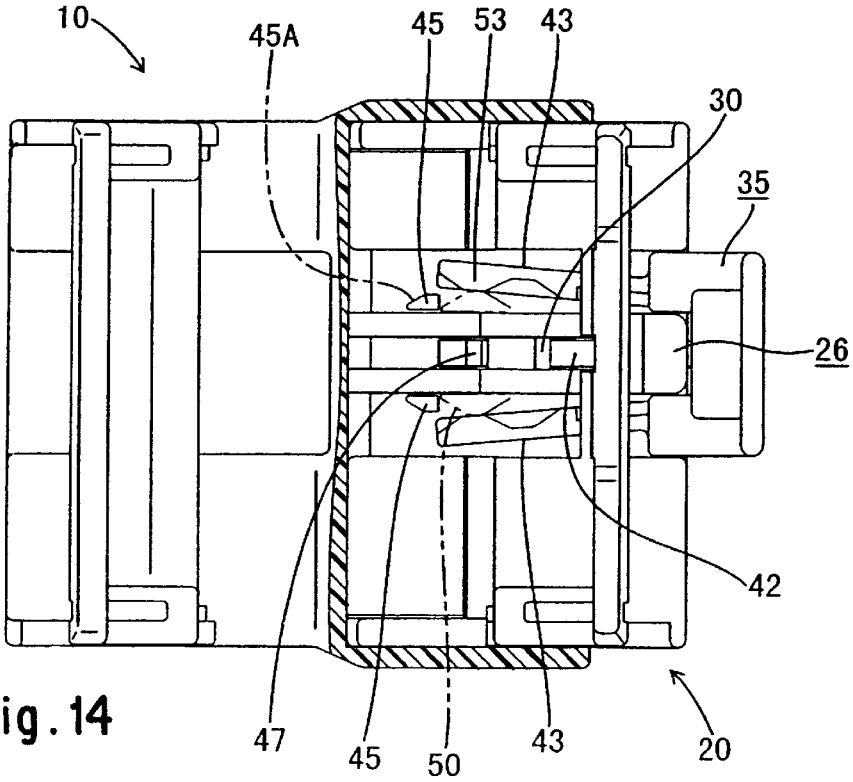
FIG. 14 is a partially cut-away plan view showing the male and female housings in a correct fitting state.

If the female housing 20 is fitted into the hood 12 of the male housing 10 while the detecting member 35 is in the temporary attaching position relative to the female housing 20, inclined faces 53A and 50A of the contacting members 53 and the releasing members 50 mutually engage, thereby bending the contacting rods 43 outwards. As shown in FIG. 14, when the female housing 20 is correctly fitted with the make housing 10, the contacting members 53 rise fully over the releasing members 50, and the anterior ends of the contacting rods 43 are distant from the stoppers 45. That is, the detecting member 35 is no longer prevented from moving in the anterior direction by the stoppers 45.

If the detecting member 35 is pushed in from this state, the contacting rods 43 return to their original straight state immediately after the contacting members 53 have passed the releasing members 50, and the releasing members 50 fit with the upper stopping holes 54.

Figure 18:
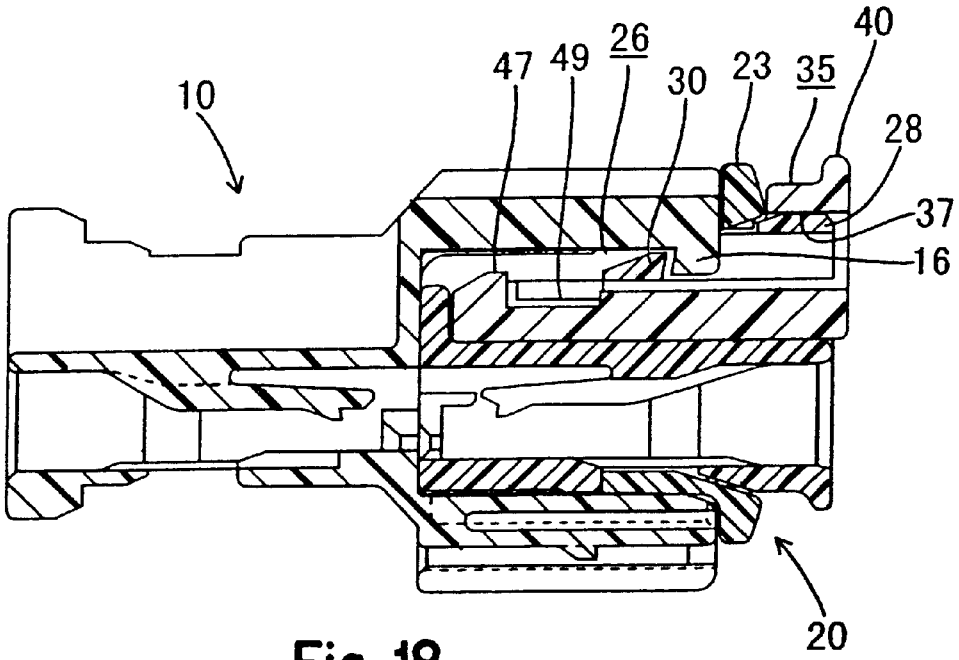
FIG. 18 is a vertical cross-sectional view, shown from the position of the locking arm, of the detecting member in the state whereby it has been pushed to the main attaching position.

As shown in FIG. 14, anterior outer corners of the stoppers 45, which make contact with the anterior ends of the contacting rods 43, form inclined faces 45A. Moreover, as shown in FIG. 9, lower stopping holes 56 are formed in lower inner faces of the contacting rods 43 at a specified distance from the anterior ends thereof. These lower stopping holes 56 are shaped so as to fit with the stoppers 45. The lower stopping holes 56 fit with the stoppers 45 at the time when the contacting rods 43 return to their original position, and the releasing members 50 fit with the upper stopping holes 54. At this juncture, the detecting members 35 is in a main attaching position. In this main attaching position, as shown in FIG. 18, the extending ends of the locking arm 26 fit into the fitting hole 37 of the base member 36 of the detecting member 35.

The present embodiment is configured as described above. Next, the operation thereof will be described.

Firstly, the detecting member 35 is attached to the female housing 20 in the temporary attaching position described earlier. That is, as the detecting member 35 is inserted from the posterior of the housing groove 25, the retaining hook 47 of the retaining rod 42 makes contact with the locking member 30 thereby bending the locking arm 26 slightly upwards. Immediately after the two contacting rods 43 make contact with the corresponding stoppers 45, thereby halting the insertion process, the locking arm 26 returns to its original position, and the retaining hook 47 engages with the anterior of the locking member 30. In this manner, the detecting member 35 is attached in the temporary attaching position in a state whereby it is retained in the anterior and posterior directions (see FIGS. 1 and 10).

In this state, the female terminal fittings are inserted into the cavities 21 of the female housing 20 and are doubly retained by the retainer 23. The male terminal fittings are also inserted into the cavities 13 of the male housing 10 and are doubly retained by the retainer 15.

Figure 12:
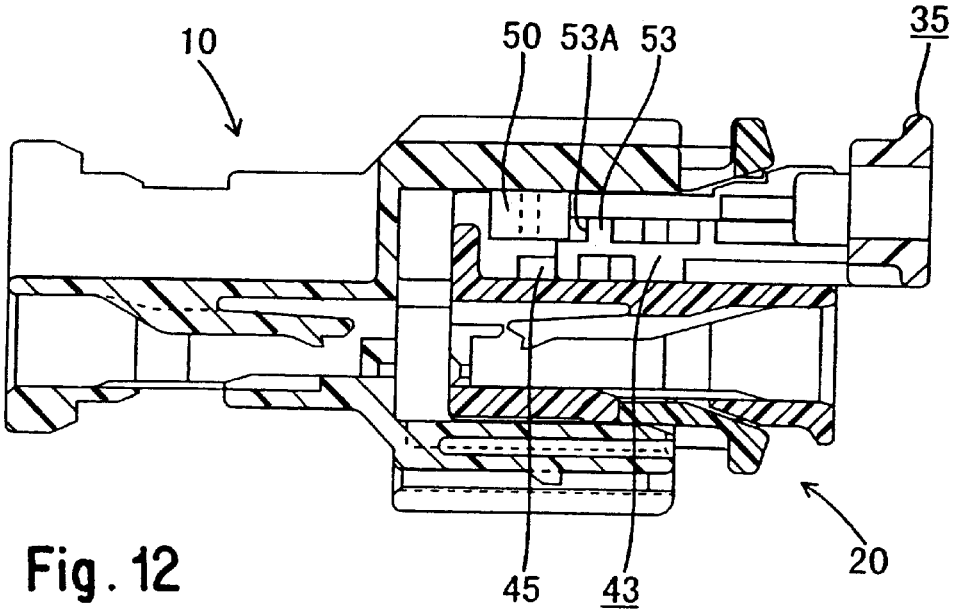
FIG. 12 is a vertical cross-sectional view, shown from the position of one of the contacting rods of the detecting member, of the male and female housings being fitted together.

Next, as shown by the arrow in FIG. 1, the female housing 20, which has the detecting member 35 attached thereto in the temporary attaching position, is fitted into the hood 12 of the male housing 10. As this fitting progresses, the protrusion 16 makes contact with the guiding face 31 of the locking member 30 of the locking arm 26. As a result, as shown in FIGS. 11 and 12, the extending ends of the locking arm 26 are bent downwards over a base end of the retaining rod 42 as the locking arm 26 is pushed inwards.

As this fitting progresses, as shown in FIG. 13, the inclined faces 53A of the contacting members 53 on the contacting rods 43 of the detecting members 35 engage with, and are guided by, the inclined faces 50A of the releasing members 50 provided on the ceiling face of the hood 12. Consequently, the contacting rods 43 bend outwards.

Figure 16:
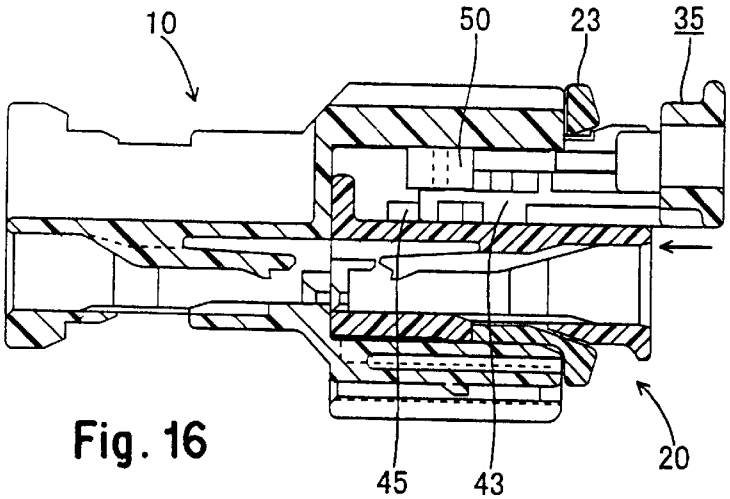
FIG. 16 is a vertical cross-sectional view, shown from the position of one of the contacting rods of the detecting member, of the male and female housings in the correct fitting state.

As shown in FIGS. 14 and 16, when the female housing 20 is pushed in to the correct fitting position, whereby the anterior face thereof reaches the inner wall of the hood 12, the contacting members 53 rise fully over the releasing members 50 and the anterior ends of the contacting rods 43 are distant from the stoppers 45. The detecting member 35 is thereby no longer prevented from moving in the anterior direction by the stoppers 45.

Figure 15:
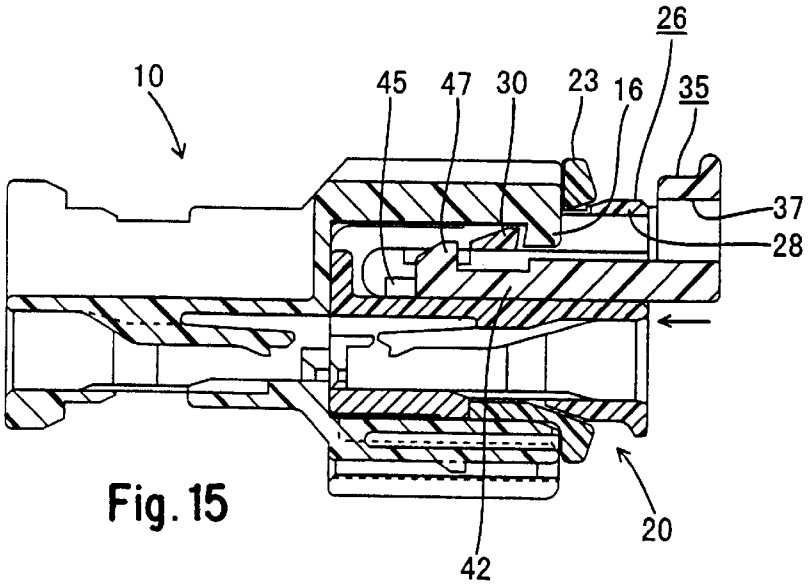
FIG. 15 is a vertical cross-sectional view, shown from the position of the locking arm, of the male and female housings in the correct fitting state.

Then, as shown in FIG. 15, the locking member 30 of the locking arm 26 passed the protrusion 16 of the retaining rod 42 of the detecting member 35, the locking arm 26 returns to its original position, and the locking member 30 engages with the protrusion 16, thereby locking the two housings 10 and 20 in to he correctly fitted state.

Figure 17:
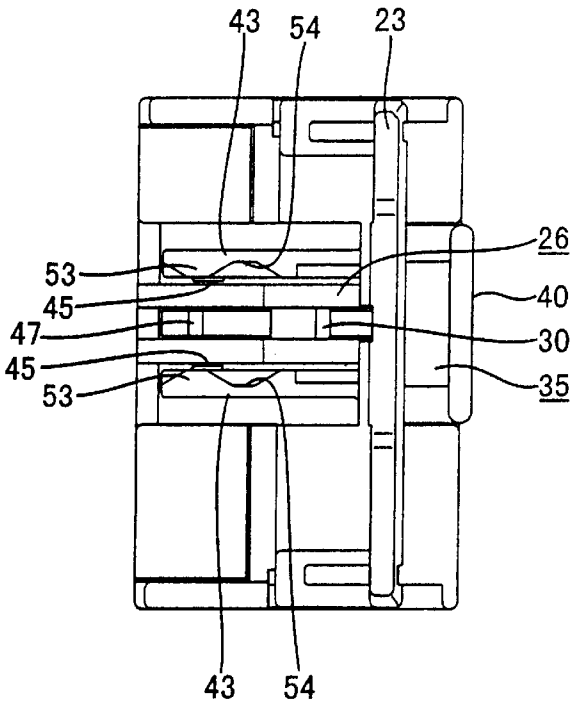
FIG. 17 is a plan view showing the detecting member in a state whereby it has been pushed to a main attaching position.
Figure 19:
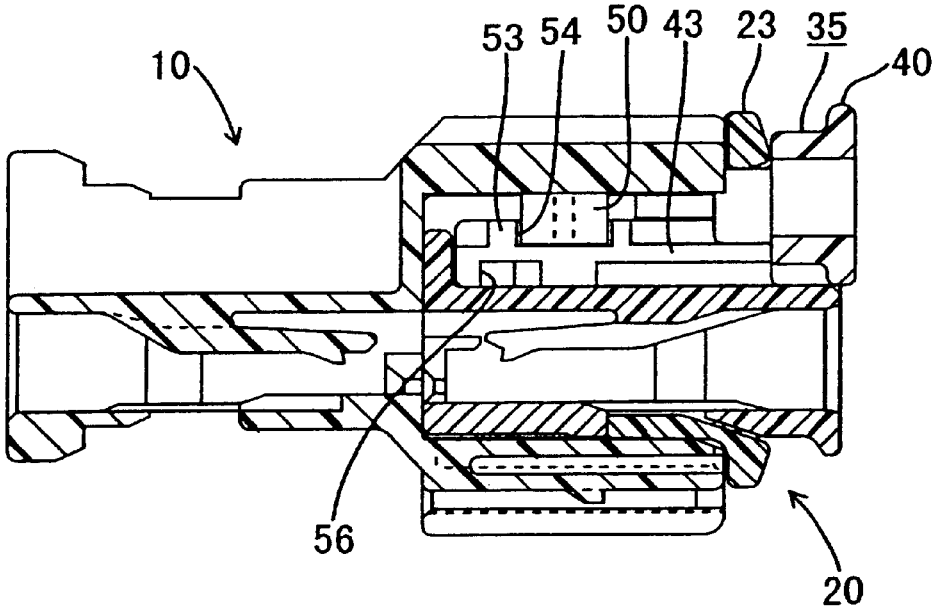
FIG. 19 is a vertical cross-sectional view, shown from the position of one of the contacting rods of the detecting member, of the detecting member in the state whereby it has been pushed to the main attaching position.

As shown by the arrows in FIGS. 15 and 16, the detecting member 35 is pushed in to the main attaching position after the two housings 10 and 20 have been fitted together. As shown in FIGS. 17 to 19, after the detecting member 35 has been pushed in until it makes contact with the retainer 23, the contacting members 53 of the contacting rods 43 pass the releasing members 50. Consequently, the contacting rods 43 return to their original straight state and the releasing members 50 fit with the upper stopping holes 54. Simultaneously, the stoppers 45 engage with the lower stopping holes 56 of the contacting rods 43, thereby retaining the detecting member 35 in the main attaching position.

When the two housings 10 and 20 are fitted together, the female housing 20 may not be pushed in as far as the correct fitting position, thus remaining in a half-fitted state. In this case, as shown in FIG. 11, since the extending ends of the locking arm 26 are bent downwards, a lower side of the base member 36 of the detecting member 35 makes contact with the extending end faces of the locking arm 26, thereby preventing the detecting member 35 from being pushed in further. As a result, the half-fitted state of the two housings 10 and 20 can be detected, and the female housing 20 can be pushed in to the correct fitting position.

As shown in FIG. 18, if the detecting member 35 is pushed in to the main attaching position when the two housings 10 and 20 have been correctly fitted together, the extending ends of the locking arm 26 fit into the fitting hole 37 of the frame-shaped base member 36 of the detecting member 35. As a result, the locking arm 26 is prevented from bending upwards or downwards.

If the two housings 10 and 20 are to be separated for maintenance or the like, the operation is performed as follows. The portions of the upper stopping holes 54 of the contacting rods 43 of the detecting member 35 which engage with the releasing members 50, as well as the portions of the lower stopping holes 56 which engage with the stoppers 45, engage therewith in a tapering shape, thereby resulting in a semi-locking configuration. Consequently, if one uses a finger to push the catching member 40 of the base member 36 of the detecting member 35 strongly towards the posterior from the state shown in FIG. 19, the contacting rods 43 bend outwards and the contacting members 53 pass over the releasing members 50. After the catching member 40 has been pushed for a specified distance to the posterior, the retaining hook 47 of the retaining rod 42 makes contact with the locking member 30 of the locking arm 26, thereby halting movement towards the posterior.

At this juncture, the extending ends of the locking arm 26 are located towards the anterior side of the fitting hole 37 of the base member 36 of the detecting member 35. The pressing member 28 at the extending ends of the locking arm 26 is pressed. Then the locking member 30 moves into the recessed member 49 of the retaining rod 42 of the detecting member 35 as the locking arm 26 bends downwards, and the locking member 30 moves downwards below the protrusion 16 of the hood 12 of the male housing 10, thereby releasing the lock. Following this, the detecting member 35 is pulled together with the female housing 20 towards the posterior, the female housing 20 thereby being removed from the hood 12 of the male housing 10. The contacting rods 43 of the detecting member 35 return to their original straight state as this removal progresses.

In the present embodiment, the means for retaining the detecting member 35 in the temporary attaching position is provided by the locking arm 26. Since the dead space in the moving space of this locking arm 26 is used for this means, the female housing 20 does not become unnecessarily large.

When the two housings 10 and 20 have been locked in the correctly fitted state and the detecting member 35 has been pushed in to the main attaching position, the extending ends of the locking arm 26 are in a fitted state within the fitting hole 37 of the frame-shaped base member 36 of the detecting member 35. Consequently, the locking arm 26 is not only prevented from moving downwards to the lock releasing direction, but also from moving upwards.

Furthermore, anterior ends of the contacting rods 43 which protrude from the detecting member 35 are divided into upper and lower portions. The lower portion serves the function of retaining the detecting member 35 in the anterior direction, and the upper portion serves the function of releasing this anterior retained state. As a result the configuration remains simple.

The present invention is not limited to the embodiments described above with the aid of figures. For example, the possibilities described below also lie within the technical range of the present invention. In addition, the present invention may be embodied in various other ways without deviating from the scope thereof.

(1) The detecting member may be inserted in a direction at a right angle to the locking arm.

(2) The locking arm and the detecting member may be provided on the male housing rather than on the female housing as in the present embodiment.

What is claimed is:

1. An electrical connector comprising two mutually engageable connector housings, one of said housings having a resilient latching arm for engaging and retaining the other of said housings in a fully fitted condition, said latching arm having a bending space to permit bending thereof during movement of said housing through a half fitted condition to the fully fitted condition, wherein a detecting member is insertable from an exterior position into said bending space, full insertion of said detecting member being prevented by bending of the latching arm in the half fitted condition, wherein the detecting member includes a retaining member to engage the latching arm to prevent separation of the detecting member from the latching arm, wherein said detecting member includes a resilient elongate member extending in a direction of insertion into said one housing, said elongate member being releasably engageable with an abutment member of said other connector housing to retain said detecting member in said bending space in the fully fitted condition, and wherein said elongate member is engageable with said abutment member of said one housing to prevent full insertion of said detecting member into said bending space in the half fitted condition, said abutment and elongate members being disengageable on bending of said elongate member by a releasing member, and a hole to receive a portion of the latching arm in the fully fitted condition to prevent any substantial movement of the latching arm, wherein the elongate member includes extending rods with upper and lower sections, and wherein one of the sections temporarily stops movement of the detecting member in an anterior direction and the other of the sections releases the stopped condition for full insertion of the detecting member.

2. A connector according to claim 1 wherein said aperture is defined by a frame.

3. A connector according to claim 2 wherein said detecting member is slidable in a direction of elongation of said latching arm.

4. A connector according to claim 1 wherein said detecting member has two parallel rods extending on either side of said latching arm.

5. A connector according to claim 4 further comprising a second abutment member, wherein said two resilient elongate members have mutually facing recesses for engagement with one of said respective abutment member.

6. A connector according to claim 5 wherein said detecting member including a retaining arm extending between said two resilient elongate members and having a protrusion to engage said latching arm.

7. A connector according to claim 6 wherein said protrusion is engageable in an aperture of said latching arm.

8. A connector according to claim 1 wherein said detecting member has two parallel resilient elongate members extending on either side of said latching arm.

9. A connector according to claim 8 further comprising a second abutment member, wherein said two resilient elongate members have mutually facing recesses for engagement with one of said respective abutment members.

10. A connector according to claim 9 wherein said detecting member including a retaining arm extending between said two resilient elongate members and having a protrusion to engage said latching arm.

11. A connector according to claim 1 wherein said retaining member includes a protrusion engageable in an aperture of said latching arm.

* * * * *